United States Patent [19]

Isham et al.

[11] Patent Number: 4,928,853

[45] Date of Patent: May 29, 1990

[54] END AISLE FLUID MIXING AND DISPENSING SYSTEM

[75] Inventors: William R. Isham, Farmington; E. Brent Cragun, Mountain Green, both of Utah; Christopher Gault, Middletown, Wis.; William J. Wermeling, Wilton, Conn.

[73] Assignee: Fountain Fresh, Inc., Salt Lake City, Utah

[21] Appl. No.: 234,174

[22] Filed: Aug. 19, 1988

[51] Int. Cl.[5] ..... B67D 1/16; B67D 5/56; B67D 5/62

[52] U.S. Cl. ..... 222/108; 137/312; 141/86; 141/92; 222/129.1; 222/146.6; 222/608

[58] Field of Search ..... 222/108, 608, 160, 146.6, 222/129.1, 129.2, 129.3, 105, 95, 129.4, 144.5, 145, 54, 66; 137/312; 141/86, 88

[56] References Cited

U.S. PATENT DOCUMENTS

| | | | |
|---|---|---|---|
| 60,344 | 12/1866 | Devoe . | |
| 67,869 | 8/1867 | Gatley . | |
| D. 81,853 | 7/1930 | Grant . | |
| D. 117,907 | 12/1939 | Martin . | |
| D. 144,931 | 6/1946 | Paley | D2/3 |
| D. 154,457 | 7/1949 | Blanchard et al. | D2/3 |
| D. 175,250 | 8/1953 | Faust | D2/3 |
| D. 271,462 | 11/1983 | Lents | D7/305 |
| D. 287,688 | 1/1987 | Mortimer | D7/307 |
| D. 287,689 | 1/1987 | Mortimer | D7/307 |
| D. 288,516 | 3/1987 | Mortimer | D7/307 |
| D. 294,105 | 2/1988 | Matthews | D7/307 |
| 317,482 | 5/1885 | Albach et al. . | |
| 422,834 | 3/1890 | Puffer . | |
| 537,434 | 4/1895 | Berner . | |
| 545,915 | 9/1895 | Russell . | |
| 679,295 | 7/1901 | Chandler . | |
| 926,550 | 6/1909 | Dafoe . | |
| 991,664 | 5/1911 | Strasburger . | |
| 1,521,928 | 1/1925 | Campbell . | |
| 1,661,602 | 3/1928 | Dary . | |
| 1,765,557 | 6/1930 | Wright . | |
| 1,795,763 | 3/1931 | Cramer . | |
| 1,883,787 | 10/1932 | Head et al. . | |
| 2,011,891 | 8/1935 | Bowen et al. | 226/125 |
| 2,065,466 | 12/1936 | Horn | 141/7 |
| 2,110,840 | 3/1938 | Kann | 225/1 |
| 2,140,589 | 12/1938 | Lannmark | 198/131 |
| 2,154,677 | 4/1939 | Hartman | 225/21 |

(List continued on next page.)

FOREIGN PATENT DOCUMENTS

| | | | |
|---|---|---|---|
| 2336754 | 2/1974 | Fed. Rep. of Germany | 222/129.1 |
| 881973 | 5/1943 | France . | |

*Primary Examiner*—Kevin P. Shaver

*Attorney, Agent, or Firm*—Workman, Nydegger & Jensen

[57] ABSTRACT

Apparatus for dispensing soft drinks comprises a cabinet placed on the end of a conventional grocery store aisle. The cabinet has three sections; an upper section, a central section, and a lower section. Containers of soft drink syrup are removably located within the lower section of the cabinet and connected to the remainder of the apparatus by tubing. The upper section includes a conventional carbonation factory connected to a source of water remote from the apparatus. Water entering the apparatus passes through a cooler and the carbonation factory to produce carbonated water. Also disposed within the interior of the upper section are a plurality of pumps. The pumps are placed in communication with each source of syrup to force the syrup upwardly through the device by way of a syrup line, which is in turn placed in communication with the source of carbonated water to form a soft drink. Once the syrup component is mixed with the carbonated water component, it is then pumped downwardly to the center section of the cabinet. The center section of the cabinet includes a plurality of dispensing pumps and dispensing nozzles for dispensing the freshly mixed soft drink into a container. A waste container for collecting excess waste liquid is disposed in the lower section. The waste container includes a pump and conduit which extends through the top of the cabinet for removing the waste liquid.

46 Claims, 3 Drawing Sheets

U.S. PATENT DOCUMENTS

| | | | |
|---|---|---|---|
| 2,235,885 | 3/1941 | Johnson | 220/34 |
| 2,321,844 | 6/1943 | Nicholson | 225/21 |
| 2,401,914 | 6/1946 | Peitro | 225/26 |
| 2,462,019 | 2/1949 | Bowman | 225/26 |
| 2,536,419 | 1/1959 | Brunell et al. | 222/112 |
| 2,558,522 | 6/1951 | Knapp | 225/21 |
| 2,598,665 | 6/1952 | Levings | 225/21 |
| 2,643,866 | 6/1953 | Kollsman | 261/76 |
| 2,655,929 | 10/1953 | Herold | 134/131 |
| 2,674,263 | 4/1954 | Rupp et al. | 137/604 |
| 2,698,703 | 1/1955 | Harvey | 222/207 |
| 2,763,994 | 9/1956 | Chandler | 62/7 |
| 2,770,394 | 11/1956 | Mueller | 222/1 |
| 2,776,074 | 1/1957 | St. Laurence | 222/129.4 X |
| 2,788,027 | 4/1957 | Ullman et al. | 141/1 |
| 2,812,117 | 11/1957 | Butkus et al. | 222/189 |
| 2,827,931 | 3/1958 | Melvin | 141/331 |
| 2,834,190 | 5/1958 | Andrews et al. | 222/54 X |
| 2,934,243 | 4/1960 | Metzger | 222/145 |
| 2,961,127 | 11/1960 | Reynolds et al. | 222/129.4 X |
| 2,977,025 | 3/1961 | Scott | 222/108 |
| 3,011,681 | 12/1961 | Kromer | 222/1 |
| 3,021,685 | 2/1962 | Gore et al. | 62/39 |
| 3,034,685 | 3/1962 | Breitenstein | 222/132 |
| 3,039,656 | 6/1962 | Wentz | 222/173 |
| 3,058,620 | 10/1962 | Kromer | 222/1 |
| 3,120,326 | 2/1964 | Hedeman | 222/144.5 |
| 3,122,151 | 2/1964 | Chambers | 134/99 |
| 3,142,267 | 7/1964 | Shofer | 222/129.2 |
| 3,162,323 | 12/1964 | Kromer | 222/1 |
| 3,185,348 | 5/1965 | Pollak et al. | 222/95 |
| 3,193,143 | 7/1965 | Maieli | 222/42 |
| 3,200,997 | 8/1965 | Creswick | 222/145 |
| 3,206,069 | 9/1965 | Jacobs et al. | 222/1 |
| 3,208,639 | 9/1965 | Marwell et al. | 222/82 |
| 3,209,952 | 10/1965 | Cornelius | 222/129.1 |
| 3,215,312 | 11/1965 | Guzzi | 222/146.6 X |
| 3,224,641 | 12/1965 | Morgan | 222/129.1 |
| 3,240,395 | 3/1966 | Carver | 222/129.1 |
| 3,245,437 | 4/1966 | Holz | 141/331 |
| 3,259,273 | 7/1966 | Kromer | 222/1 |
| 3,263,864 | 8/1966 | Welty et al. | 222/129 |
| 3,289,948 | 12/1966 | Fuerst | 239/406 |
| 3,354,924 | 11/1967 | Birrell et al. | 150/0.5 |
| 3,418,069 | 12/1968 | Decupper | 21/74 |
| 3,435,990 | 4/1969 | Pike, Jr. | 222/1 |
| 3,460,593 | 8/1969 | Niehaus et al. | 141/372 |
| 3,503,541 | 3/1970 | Jacobs et al. | 222/129.1 |
| 3,583,601 | 6/1971 | Ayers | 222/129.1 X |
| 3,587,597 | 6/1971 | Courtney et al. | 134/95 |
| 3,727,844 | 4/1973 | Bencic | 239/414 |
| 3,863,810 | 2/1975 | Hanson | 222/129.1 |
| 3,876,107 | 4/1975 | Meindl et al. | 222/64 |
| 3,904,079 | 9/1975 | Kross | 222/108 X |
| 3,934,759 | 1/1976 | Giannella et al. | 222/129.1 |
| 3,940,019 | 2/1976 | Kross et al. | 222/108 X |
| 3,949,902 | 4/1976 | Thompson | 222/129.1 |
| 3,961,569 | 6/1976 | Kenyon et al. | 99/451 |
| 4,086,057 | 4/1978 | Everett | 21/54 |
| 4,129,231 | 12/1978 | Larson | 222/145 |
| 4,171,069 | 10/1979 | Cornelius et al. | 222/1 |
| 4,174,049 | 11/1979 | Bolen | 222/5 |
| 4,240,475 | 12/1980 | Schulz | 141/392 |
| 4,271,877 | 6/1981 | Whitaker | 141/166 |
| 4,271,987 | 6/1981 | Eriksson | 222/160 |
| 4,305,527 | 12/1981 | McMillin | 222/1 |
| 4,333,587 | 6/1982 | Fessler | 222/129.1 |
| 4,404,988 | 9/1983 | Trammell | 137/312 X |
| 4,421,253 | 12/1983 | Croley | 222/105 |
| 4,456,022 | 6/1984 | Roberts | 134/99 |
| 4,457,221 | 7/1984 | Geren | 99/451 |
| 4,469,150 | 9/1984 | Grimaldi | 141/95 |
| 4,484,697 | 11/1984 | Fry, Jr. | 222/95 |
| 4,498,508 | 2/1985 | Scholle et al. | 141/5 |
| 4,567,926 | 2/1986 | Lichfield et al. | 141/332 |
| 4,590,974 | 5/1986 | Matthews | 141/1 |
| 4,687,120 | 8/1987 | McMillin | 222/146.6 X |
| 4,708,153 | 11/1987 | Hambleton et al. | 134/170 |
| 4,747,516 | 5/1988 | Baker | 222/129.1 |
| 4,795,061 | 1/1989 | Peckjian | 222/66 |
| 4,804,118 | 2/1989 | Mullen et al. | 222/146.6 X |

END AISLE FLUID MIXING AND DISPENSING SYSTEM

BACKGROUND

1. The Field of the Invention

The present invention is generally related to an apparatus for conveying, mixing, and dispensing fluid mixtures. More particularly, the present invention is related to a soft drink mixing and dispensing apparatus which can be placed on the end of a conventional grocery store aisle without requiring specialized plumbing and electrical connections.

2. The Background of the Invention

Soft drinks and related products have recently achieved a very high degree of popularity. Sales of soft drinks and related products have driven the growth of some of the largest and fastest growing corporations in the United States and worldwide. The soft drink industry has become a massive business. One of the problems with the sales and marketing of soft drinks is, however, that they are relatively expensive. Consumer demand would likely expand even further if the cost of soft drinks and related products could be kept lower.

Some of the reasons for the high cost of soft drinks are unrelated to the actual cost of the ingredients to make the drink. For example, soft drink containers are relatively expensive when compared with the cost of the finished product. Expensive metal cans or plastic containers are presently widely used to dispense soft drinks. At the same time, the price of metal, such as aluminum, is high. Plastic soft drink containers are also expensive when compared to the cost of the actual soft drink contained within the container. While some soft drink containers are recyclable, notably aluminum cans, most soft drink containers are not, in practice, recycled. For example, it is unusual to recycle plastic bottles.

A further factor in increasing the cost of soft drinks is expensive bottling techniques. While soft drink bottling is highly automated, the cost of the automated equipment is high. At the same time, significant labor is involved in both soft drink bottling and distributing the filled bottles. Thus, labor and equipment costs add significantly to the cost of the soft drink.

As a result of the factors discussed above, the actual soft drink purchased in a grocery store or other retail outlet may represent a relatively minor portion of the cost of the finished product. A significant portion of the cost is represented by the cost of the soft drink container and the labor and equipment costs in manufacturing the drink, filling the containers, and distributing the filled containers.

The same may be said for other types of food items and consumer products. For example, cleaning products, especially liquid cleaners, are dispensed in relatively expensive containers, with labor and equipment costs representing another large portion of the cost of the product. The costs of other products, such as peanut butter, shampoos, salad dressings, cooking oils and the like are also heavily impacted by the factors discussed above.

Thus, it would be an economic advantage to the consumer, the manufacturer, and the retail outlet alike to reduce the cost of these types of items. Reduction in cost would very likely increase the volume of products sold by the retail outlet, increasing profits for both the retailer and the manufacturer. At the same time, the lower cost would be an obvious benefit to the consumer.

Two ways that cost could be controlled would be through the reuse of reusable containers and through reducing the cost of equipment and labor in filling those containers. Specifically, it would be beneficial to provide the consumer with a reusable container which the consumer could himself refill at the retail outlet.

In the past, however, it has been difficult to provide the necessary equipment for refilling containers at a retail outlet. This is particularly true in the case of goods such as soft drinks that require the mixing of two or more components for the formation of the final product.

One of the major limitations on such equipment is that of size. Square footage within a retail outlet is at a premium. Equipment and display cases placed within a retail outlet must be of optimum size. In order to dispense a large volume of soft drinks, however, conventional equipment is too large to justify its use. In order to justify use in a grocery store setting, equipment must be configured such that it fits within the conventional aisle configuration of the store.

It is found that equipment that is more than approximately 4 feet wide is generally too large to fit in a conventional space. Such a piece of equipment would hurt the flow of customer traffic through the store and would take up valuable footage, and may cause a safety hazard which would be unacceptable in a retail outlet. Accordingly, most soft drink mixing and dispensing apparatus which have the capacity to dispense large volumes of soft drink is not adaptable to fit within a conventional grocery store space.

An additional problem arises when it is necessary to mix various components of the product dispensed. For example, with respect to soft drinks it is necessary to mix carbonated water with a flavoring. There is a need, therefore, for a source of each component, and each component must be properly pumped, treated, and mixed. This presents complex problems when attempting to install a dispensing machine within a conventional grocery store space.

One particular problem is with respect to carbonated water. Carbonated water degenerates rapidly. If it is necessary to pipe carbonated water to the site of dispensing the soft drink it is necessary to use special equipment that maintains the carbonation within the liquid. Alternatively, tanks of carbonated water may be used. However, these are expensive, must be replaced regularly, and take up a large amount of space. The use of these tanks is not generally preferred when it is necessary to dispense large volumes of soft drinks.

One type of conventional apparatus comprises a rack holding several different tanks. Each tank is placed in fluid communication with a dispensing outlet. It will be appreciated, however, that the tanks take up a large amount of space which is at a premium in a grocery store. At the same time, the contents of the tanks must be replaced regularly in order to maintain a supply of the material dispensed. This can be a time consuming and labor intensive task.

Other devices dispense liquids which flow from a remote source. For example, carbonated water and flavorings are both pumped in from remote sources. As mentioned above however, in order to maintain the carbonation in the liquid it is necessary to employ expensive specialized equipment.

An additional problem in all devices of this type is maintaining the components of the soft drink (or other product) at a desirable temperature. It is generally necessary to have a cooling apparatus to prevent excess heating of the product. Some devices attempt to cool the components of the product at a remote storage location and then transport the cooled liquid. With this system significant heating of the liquid occurs during transportation from the remote location to the dispenser, defeating the previous cooling.

The pumping of syrups, flavorings and related components from a remote location has additional disadvantages. For example, when it is necessary to clean the apparatus, a large quantity of the valuable syrup, flavoring, or other component must be removed from the lines and discarded. The cost of cleaning the apparatus can make the apparatus very expensive in operation.

An additional problem is the necessity of specialized drains, plumbing fixtures and electrical outlets in order to operate the equipment. If the apparatus produces waste material, the waste material is generally disposed of down a drain. This requires that the apparatus be installed at a location where a drain is available. If a drain is not already in place, one must be installed.

The same is true with respect to a water supply. Many devices of this type require a significant volume of water close to the device. Thus, if such a source is not immediately available, one must be installed. Such limitations may effectively prevent an apparatus from being positioned at certain locations in a store.

It would, therefore, be a significant advancement in the art to provide an apparatus which was capable of mixing and dispensing fluids which overcame the problems set forth above. In particular, it would be an advancement in the art to provide such a mixing and dispensing apparatus which was transportable and could be located at virtually any location within a retail outlet, without modifying the plumbing or electrical system of the building. It would also be a significant advancement in the art to provide an apparatus which was capable of being installed at the end of a conventional grocery store aisle without blocking the aisle.

It would be another advancement in the art to provide a soft drink dispensing apparatus which had on-site cooling and carbonation capabilities. It would be a related advancement in the art to provide an apparatus which also contained sources of the other items necessary to mix soft drinks or the like, such as syrups. It would also be an advancement in the art to provide an apparatus which was capable of disposing of fluid waste products without the necessity of a floor drain. Another advancement in the art would be to provide such an apparatus which was able to control heat by having the heat producing equipment in the upper section of the apparatus so that heat is vented out the top of the apparatus.

Such an apparatus is disclosed and claimed herein.

BRIEF SUMMARY AND OBJECTS OF THE INVENTION

The present invention is related to an apparatus for mixing and dispensing fluid mixtures. In particular, the present apparatus is adaptable for use in mixing and dispensing soft drinks. The present invention is also adaptable for mixing and dispensing other fluid or fluid-like mixtures such as cleaners, mouth wash, peanut butter, and other products.

The present invention comprises a framework which is generally enclosed within a cabinet. The cabinet is particularly configured such that it can be placed on the end of a conventional grocery store aisle. That is, it is generally no more than approximately 5 feet long and approximately 4 feet wide. Therefore, it can be used within a conventional grocery store aisle without taking up an unjustifiable amount of valuable space and without interrupting the natural traffic flow in the store.

The cabinet may be thought of as having three sections; an upper section, a central section, and a lower section. The lower section of the device comprises a cabinet-like enclosure. In a preferred embodiment of the present invention, on two opposing sides of the lower section are doors which open into the interior of the cabinet. The doors are designed to allow a user to place containers of one or more components of the fluid mixture inside the lower section of the cabinet.

In one embodiment of the present invention, containers of soft drink syrup, or other type of concentrated liquid, are removably located within the lower section of the cabinet. These containers may take the form of conventional bag-in-box containers or any alternative conventional container. The lower section of the cabinet is configured so that carts containing numerous bag-in-box containers may be inserted inside the lower section.

The lower section of the device also comprises sufficient tubing to connect the subject containers to the remainder of the apparatus. The tubing runs from the lower section upwardly through the cabinet and connects with the remainder of the device as described in further detail below.

The lower section of the device may also include a drain means for collecting any excess fluid produced during operation or cleaning of the apparatus. The excess fluid is collected within a container which may be in communication with a pump. This allows the liquid waste to be pumped up through the apparatus and out a disposal line. Thus, the apparatus is able to operate without the necessity of a floor drain.

Also included as part of the cabinet is an upper section. In the case of dispensing a soft drink, the upper section will preferably include a conventional carbonation factory. The carbonation factory is connected to a source of water remote from the apparatus. Generally a tube containing water is run upwardly and outwardly from the apparatus and connected to a water supply. As water enters the apparatus it passes through a cooler and the carbonation factory to produce carbonated water. It will be appreciated that if products other than soft drinks are dispensed from the apparatus that another diluent may take the place of water or carbonated water.

Also disposed within the interior of the upper section are a plurality of pumps. The pumps are placed in communication with each source of syrup (or other similar concentrate) in the lower section of the device. Thus, the pumps force the syrup upwardly through the device by way of a syrup line which is in turn placed in communication with the source of carbonated water to form a soft drink.

Other items may also be disposed within the upper section. These may include a hot water bath for use in cleaning the apparatus and customer containers, as well as various warning systems for providing information concerning the ongoing operation of the pump.

The center section of the cabinet includes a plurality of dispensing pumps and dispensing nozzles for dispensing the freshly mixed soft drink into a container. the first component is mixed with carbonated water or diluent within the dispensing nozzle.

The apparatus also provides means for holding a plurality of customer containers. Thus, when a customer arrives at the apparatus he simply chooses a container and places it beneath a dispensing pump and nozzle. The customer then activates the dispensing pump and nozzle by any conventional means, such as by pressing a button.

It is, therefore, an object of the present invention to provide a mixing and dispensing apparatus which overcomes the problems encountered in the prior art.

It is a related object of the present invention to provide a mixing and dispensing apparatus which is portable and which can be installed within a conventional grocery store setting without significantly modifying the store's plumbing or electrical systems.

It is another object of the present invention to provide on site cooling and production of carbonated water in the event it is desirable to dispense a soft drink through the apparatus.

It is also an object of the present invention to provide an on site source of syrup for mixing with the carbonated water.

It is a further object of the present invention to provide an apparatus which effectively controls heat produced by the apparatus.

These and other objects of the present invention will become apparent upon reading the following detailed specification, with reference to the accompanying drawings, and upon reading the attached claims.

DETAILED DESCRIPTION OF THE PREFERRED EMBODIMENTS

1. General Features of the Invention

The present invention can best be understood with reference to the drawings wherein like parts are designated with like numerals throughout. The present invention is related to an apparatus for conveying, mixing and dispensing fluid mixtures. More particularly, the present invention is related to a soft drink mixing and dispensing apparatus which can be placed on the end of a conventional grocery store aisle without requiring specialized plumbing and electrical connections.

Figure 1:
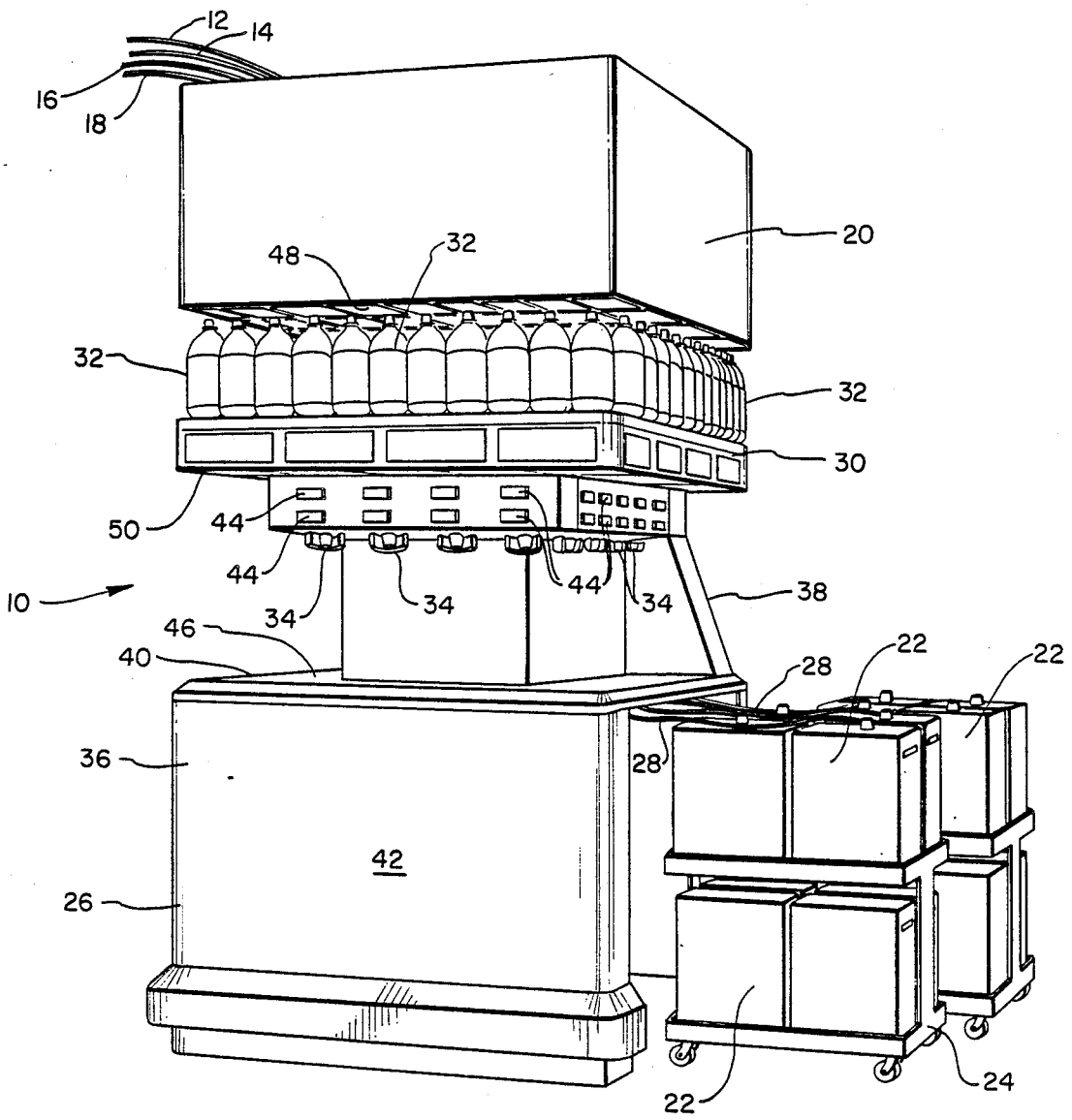
FIG. 1 is a front perspective view of the apparatus of the present invention showing the syrup containers removed from the lower section of the apparatus.

The apparatus of the present invention is illustrated in FIG. 1 and is generally designated 10. As mentioned above, the present invention provides an apparatus for mixing and dispensing fluids, such as soft drinks, without the need for specialized plumbing, water supplies, carbon dioxide supplies and electrical connections. As can be appreciated from FIG. 1, the necessary supplies for mixing and dispensing a soft drink or other type of liquid product are either contained within the apparatus itself or are run into the apparatus through the top of the apparatus.

In FIG. 1 a series of supply lines are illustrated. These lines may include a water or diluent supply line 12, a carbon dioxide supply line 14, a drain line 16 for expelling waste material from the apparatus, and an electrical cable 18. Using these lines there is no need for floor drains or on site plumbing modifications. There is also no need to tie the apparatus to an interior or exterior wall because the apparatus is completely free standing. As a result, the apparatus can be placed in any desired location, such as at the end of a conventional grocery store aisle.

As mentioned above, the apparatus 10 is self-contained. The apparatus 10 includes a carbonated water factory which is disposed within the interior of the upper section 20 of the apparatus 10. Thus, there is no need to provide for carbonated water tanks or the like within the interior of the device, and there is no need to constantly replace such tanks during the operation of the device.

The apparatus 10 includes an on site cooling unit within the upper portion 20. Thus, it is not necessary to cool the components of the ultimate mixture at a location remote from the apparatus 10. That is, it is not necessary to cool the water and then attempt to pump that water to the apparatus while still maintaining cool temperatures. It is only necessary to flow the water into the device, which is then cooled within apparatus 10.

As illustrated in FIG. 1, the apparatus 10 includes a plurality of syrup or concentrate containers. These may, for example, take the form of bag-in-box containers 22. The present invention also provides carts 24 to hold a plurality of bag-in-box containers. Eight bag-in-box containers can be mounted in each of the carts 24 illustrated in FIG. 1. It will be appreciated that to insert and remove the containers it is simply necessary to remove a door on one side of the lower section 26 and then to roll the carts 24 in or out as may be desired.

It can also be seen from FIG. 1 that each bag-in-box container is connected to the remainder of the device through a syrup or concentrate line 28. The syrup line 28 is placed in communication with the source of carbonated water, which mixture forms a final soft drink to be dispensed.

It will also be appreciated that the present invention provides a shelf 30 for holding a plurality of customer containers 32. Such containers may comprise conventional two liter soft drink containers. Alternatively, any other desirable container could also be placed on shelf 30 for use by the consumer.

The present invention provides the capability of mixing fresh high quality product. The mixing of the product takes place directly within the apparatus 10. As will be discussed in further detail below, the apparatus 10 also includes controls and alarms which monitor the quality of each individual component of the mixture.

The invention 10 also provides means for control of heat generation. Most of the major heat producing equipment contained within the apparatus 10 is contained within the upper section 20 of the apparatus. The heat producing equipment includes the carbonated water producing factory, lights, most of the pumping apparatus, most electrical equipment and water heater. The upper section 20 is then vented out the top of the apparatus. This allows one to maintain the syrup and other heat sensitive components in a relatively cool environment. Heating caused by operation of the apparatus 10 is expelled through the upper portion 20 of the apparatus.

The present invention is also easy to use and maintain. It is simply necessary to place the water supply line 12 in communication with a source of water. At the same time the carbon dioxide supply line 14, the waste supply line 16 and the electrical hookup 18 are connected to their respective hookups, which may be remote from the device. In order to supply the syrup or other similar concentrate component it is simply necessary to attach a container 22 within the lower section 26. The container is then placed in communication with the syrup lines 28.

It is presently preferred that the main components of the apparatus 10 be made of stainless steel or other easily cleaned material. In one embodiment of the present invention an automatic washing system is contained within the apparatus in order to wash the system after use. The washing system may, for example, provide a spray of water or other washing fluid which cleanses the center section 38 and then exits the device by way of spill trough 46. Thus maintenance of the apparatus 10 is simple.

2. Detailed Description of the Apparatus

The apparatus is comprised generally of a framework which is generally enclosed within a cabinet 36. The cabinet 36 as illustrated in FIG. 1 can be thought of as comprising 3 separate sections. The cabinet 36 comprises an upper section 20 which begins at the shelf 30 and continues through the top of the cabinet 36. The cabinet 36 also comprises a center section 38. Center section 38 begins at the shelf 30 and proceeds downwardly to the platform 40. Finally, the cabinet 36 comprises a lower section 42 which begins at the platform 40 and proceeds downwardly to the bottom of the device. While three different sections are defined for purpose of ease of description, it will be appreciated that the three sections form an integral unit and may preferably be constructed as an integral unit.

As mentioned above, the present invention is particularly adaptable for mixing at least two fluid or fluid-like components to form a final liquid mixture. Thus, the present invention provides sources of those components. The first component may, for example, be a soft drink syrup which may be contained in bag-in-box containers 22 mounted on carts 24. Alternatively, other similar types of concentrates may be contained within other types of containers.

In any event, the containers of the first component will generally be contained within the lower portion 42 of cabinet 36. Lower portion 42 may, for example, have removable side walls for allowing the containers 22 to be easily inserted and removed from the apparatus. At the same time, placing the containers 22 within the lower portion 42 protects the liquid components from the effects of heat. As mentioned above, most of the heat producing equipment is located in the upper portion 20 of cabinet 36. Accordingly, the heat exits the upper portion 20 without ever coming into contact with the containers 22.

In order to provide the additional supplies necessary to mix the desired liquid mixture, the apparatus 10 is provided with hookups. These various hookups may preferably leave the apparatus 10 through the top of the upper portion 20. For example, a conventional electrical hookup 18 may run from the apparatus 10 to a source of electricity. It is not necessary to wire or plumb the particular location where the apparatus 10 is resting. The apparatus 10 may be installed at any location within a grocery store or other retail outlet and the hookups can then be routed through the ceiling of the store without the necessity of providing expensive and complex plumbing and electrical connections.

When it is desirable to mix soft drinks it will be necessary to provide a source of carbonated water. As mentioned above, a carbonated water factory is located within the upper portion 20. Accordingly, it is only necessary to provide a flow of carbon dioxide and water into the apparatus 10 such as through water supply line 12 and a carbon dioxide supply line 14. A separate water source may also be provided, if desired, to supply water to the coolant apparatus and/or the washing apparatus. Alternatively, a single water line may be employed.

The water and carbon dioxide are mixed in a carbonating factory to provide carbonated water. The resulting carbonated water is cooled to a desirable temperature and then mixed with syrup which is pumped from the bag-in-box containers 22. The mixture of carbonated water and flavor then exits the dispensing nozzles 34 in the form of a soft drink.

In use a consumer will obtain a customer container 32 which may be removed from shelf 30. The container is then placed beneath the dispensing nozzle 34. In the configuration of the device illustrated in FIG. 1, the consumer can then choose one of two different flavors which will exit each individual dispensing nozzle 34. This choice is made by pressing one of two buttons 44 located directly above the corresponding dispensing nozzle 34. The consumer then holds the button 44 in the depressed position until the container 32 is filled to the desired level. Other alternative means may, of course, be employed for the consumer to activate the apparatus.

In the event that there is any excess fluid loss during the filling process, the fluid enters a spill trough which is formed integrally with platform 40. Spill trough 46 is disposed beneath the dispensing nozzles 34 and is configured so as to collect all excess fluid flowing into the spill troughs 46. As will be discussed in further detail below, the excess fluid is collected in a waste fluid container located within lower portion 42. The waste fluid container can be emptied by pumping the fluid out of cabinet 36 through waste line 16.

It will be appreciated that lighting various parts of the apparatus 10 is desirable. Accordingly, lights may be disposed within the upper portion 20 of cabinet 36. The lights can then be directed downwardly through the customer containers 32 through light fixtures 48. Likewise, lights may be disposed within the interior of shelf 30 such that light can shine downwardly out of lower light fixtures 50.

Figure 2:
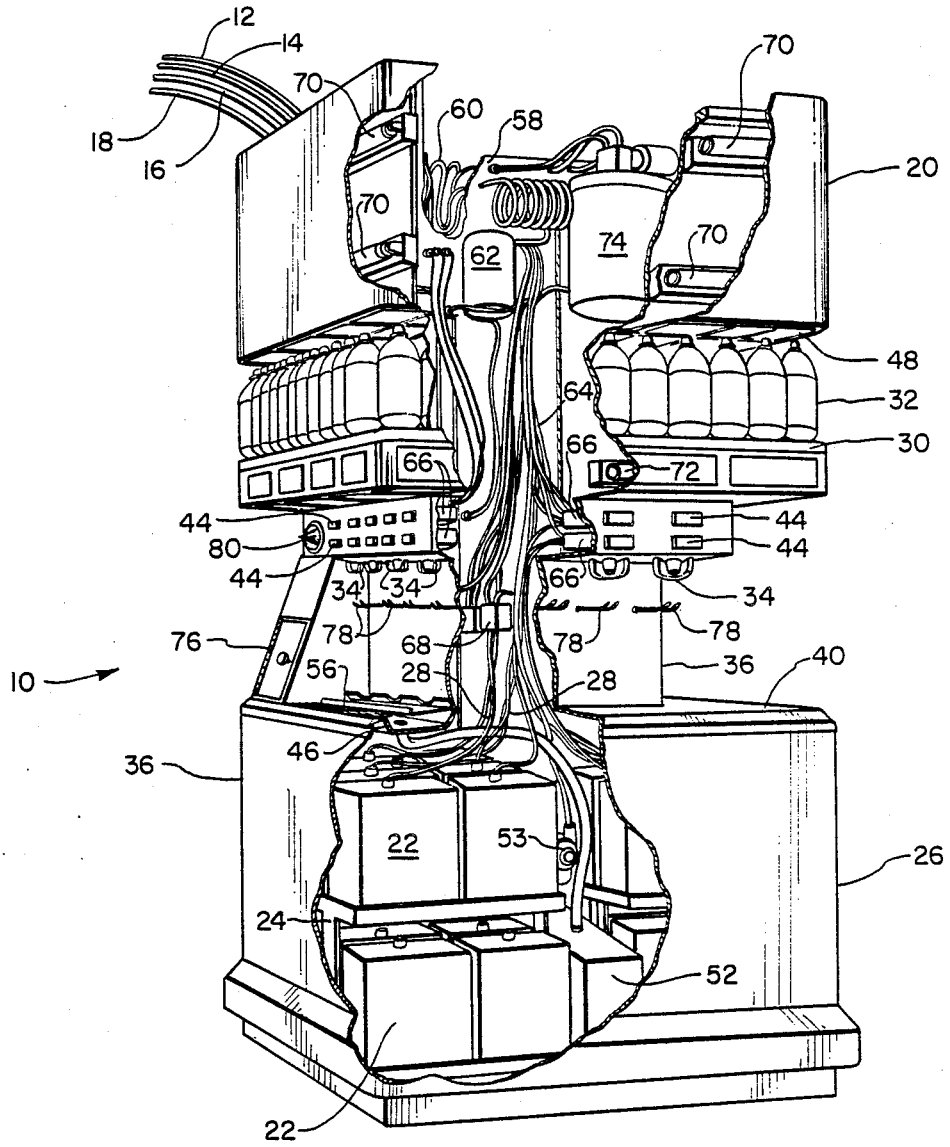
FIG. 2 is a partially broken away front perspective view of the apparatus of the present invention.

The apparatus 10 can be understood in greater detail with reference to FIG. 2. FIG. 2 illustrates the cabinet 36 being partially broken away to show the interior mechanism of the apparatus 10. As with FIG. 1, FIG. 2 illustrates the upper section 20, the lower section 26 and the center section 38 of cabinet 36. Each section of the cabinet comprises an enclosure which encloses the internal workings of the device. The enclosure may be made of any conventional material, however, stainless steel or other easily cleaned material is presently preferred.

In FIG. 2, the bag-in-box containers containing a concentrated liquid component of the final product are shown disposed within the interior of lower portion 26. As was discussed above, bag-in-box containers 22 may be mounted on a cart 24. The cart is preferably provided with wheels so that the cart can be rolled into and out of the lower portion 26. This provides a user with the capability of easily accessing the containers 22 and removing empty containers so that those containers can be replaced with full containers.

This mechanism overcomes one of the problems in the prior art. In existing mechanisms, it is often necessary to lift containers containing syrup into place at a height which was above that of the lower level of the present apparatus 10. Therefore, there was significant lifting in order to stock the apparatus.

As can also be seen with reference to FIG. 2, the containers 22 are placed in communication with syrup lines 28. Syrup lines 28 transport the fluid contained within the containers 22 upwardly to be mixed with the other component of the final liquid mixture. In the case of a soft drink, the syrup contained in containers 22 will be pumped upwardly through syrup lines 28 and ultimately mixed with carbonated water to form a completed soft drink.

In the alternative embodiment, a source of syrup may be provided remote from the apparatus which supplies the syrup source within the device. For example, a bundle of syrup supply lines may run to the apparatus to refill the syrup sources within the apparatus. These syrup lines may be provided with means for receiving syrup directly from a supply truck or other syrup source.

Also illustrated within the interior of lower portion 26 is waste container 52. Waste container 52 is placed in communication with spill trough 46 by way of a waste collection line 54. It can be seen from FIG. 2 that a grill 56 can be placed over the top of spill trough 46. Thus, any excess liquid mixture, cleaning liquids or water will flow through grill 56 into spill trough 46. The liquids will then travel through waste collection line 54 into waste container 52.

In order to avoid the requirement of a floor drain or repeated emptying of waste container 52, waste container 52 is in turn placed in communication with waste line 16. Waste line 16 enters the apparatus 10 through the upper portion 20, travels through the interior of center portion 38 and is connected onto waste container 52. A pump 53 is then placed in communication with waste line 16 so that fluids within the interior of waste container 52 are pumped out of the device through waste line 16. Thus, there is no need to construct a floor drain or repeatedly empty waste container 52.

In order to provide the carbonated water or other diluent necessary to create a final product, a source of water or diluent is established at a location remote from the cabinet 36. Water is then caused to flow into the upper portion 20 of cabinet 36 through water supply line 12. Water supply line 12 can be, for example, a simple water hose. The water which enters the device through water supply line 12 is then cooled in a cooling tank illustrated at 58. The water may be run through a series of coils 60 which are disposed within the interior of the cooling tank 58 in order to provide for rapid and effective cooling.

At the same time, carbon dioxide enters the device through carbon dioxide supply line 14. Once the water is sufficiently cooled, it is injected to a supply of carbon dioxide in a carbon dioxide factory generally designated 62. This injection procedure results in a constant supply of carbonated water made on site within the interior of apparatus 10. Carbonated water factories are well known in the art and various types of carbon dioxide factories could be substituted while still accomplishing the objects of the present invention.

Once the carbonated water is formed, it exits the carbon dioxide factory 62 through carbonated water lines 64. These carbonated water lines 64 are placed in communication with dispensing pumps 66. At the same time syrup supply lines 28 are also placed in communication with dispensing pumps 66. It will be appreciated that numerous different dispensing pumps are commercially available, many of which are usable in the present invention.

When a customer presses button 44, dispensing pumps 66 begin operation. Dispensing pumps 66 may pump both carbonated water and syrup in a predetermined proportion through dispensing nozzles 34. Thus a completed soft drink or other similar type of liquid mixture is dispensed to the customer upon demand.

In the event that syrup within any individual container 22 runs low, it will be possible to switch to another syrup container using a switching mechanism 68. Thus, an adequate supply of the most popular varieties of liquid can be maintained at all times within the apparatus 10. Switching mechanism 68 may also include a warning mechanism to alert the customer and the operator that syrup is running low within any particular container. This may take the form of activating a light behind button 44. Such mechanisms are well known and conventional in the art.

Also illustrated within the upper portion 20 are a series of fluorescent lights 70. It will be appreciated that fluorescent lights 70 may illuminate the outside container of upper portion 20 in the event that it is partially transparent. Lights 70 will also be directed downwardly through light fixtures 48 in order to illuminate customer containers 32 and the areas surrounding those containers. Likewise, an additional group of fluorescent lights 72 can be used to illuminate the area beneath shelf 30, and in particular the various buttons 44.

Fluorescent lights 70 and 72, as well as the other electrical equipment contained within the apparatus 10 is operated in any conventional manner. In particular, an electrical hookup line 18 is provided whereby electrical power is transported to the apparatus 10.

Also illustrated within the interior of upper portion 20 is a warm water tank 74. Warm water is used within an interior system to provide rinse water to the area between the dispensing nozzle 74 and the grill 56. This area may become coated with excess liquid and, in the case of soft drinks, this area may need periodic cleaning.

At the same time, the warm water tank 74 will provide water to a bottle washer 76. Any type of conventional type of bottle washer may be used, so long as a facility is provided for cleaning customer containers. Thus, the door on bottle washer 76 is open and the container 32 is placed within the interior. The bottle washer is then caused to operate rinsing the bottle using the water from warm water tank 74.

Also illustrated in FIG. 2 are a plurality of positioning brackets 78. Positioning brackets 78 are used to hold the container 32 in place while it is being filled through dispensing nozzle 34. Also illustrated is a funnel dispenser 80. Using funnel dispenser 80, a plurality of disposable funnels can be provided to a customer. The customer then places a funnel in the neck of container 32 while resting the container 32 against positioning bracket 78. Thus, liquid flowing from dispensing nozzles 34 is funneled into the interior of customer container 32 without the necessity of the container touching the dispensing nozzle. This function of the apparatus is generally described in Matthews, "Beverage Dispenser," U.S. Pat. No. 4,590,974 (issued May 27, 1986).

3. Operation of the Apparatus

Figure 3:
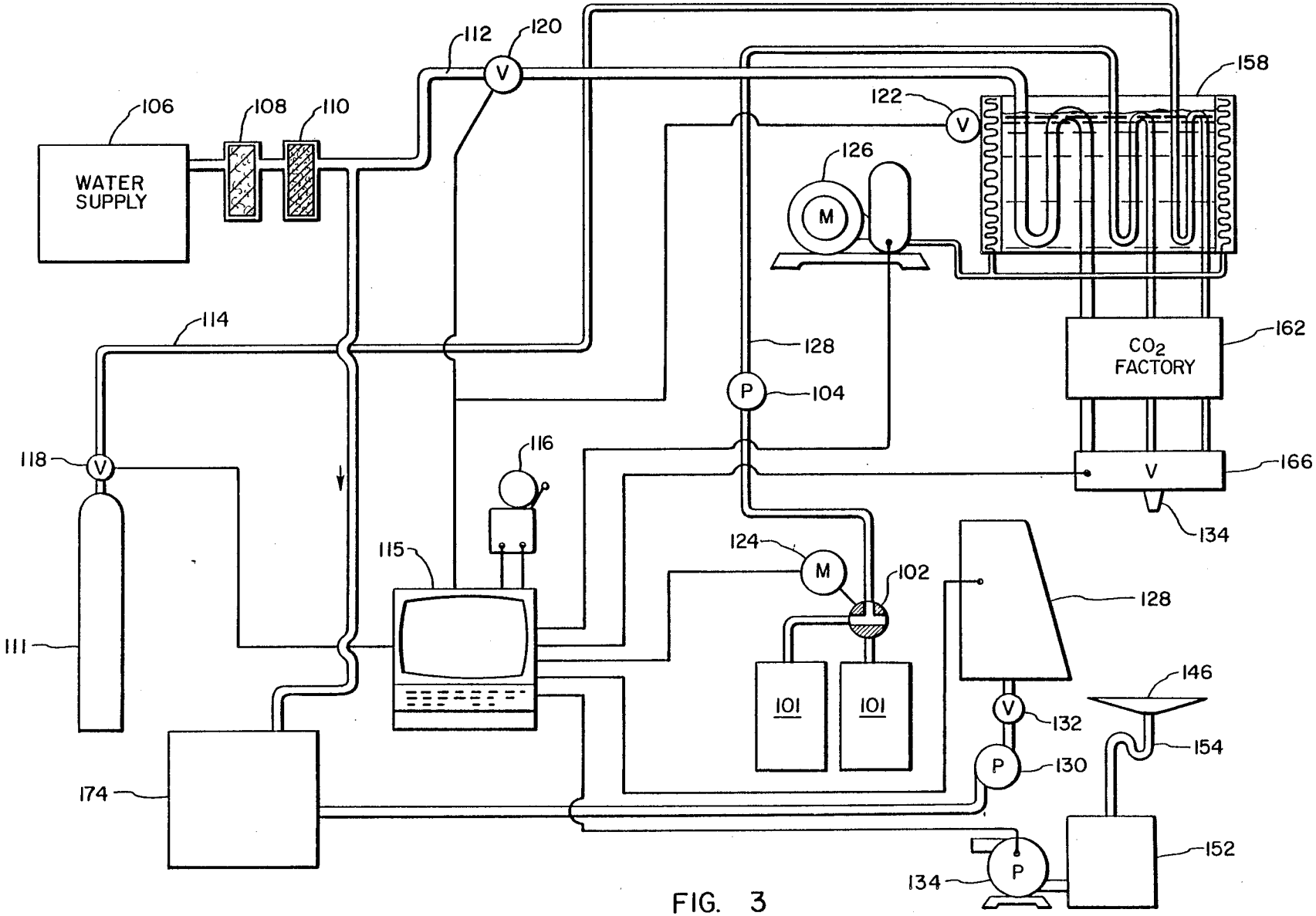
FIG. 3 is a schematic diagram of the apparatus of the present invention.

The operation of the apparatus 10 can be more fully understood with reference to FIG. 3. FIG. 3 is a schematic diagram illustrating several of the important components of the apparatus of the present invention. In order to produce the final fluid mixture it is necessary to have a supply of one liquid component within the interior of the apparatus. As discussed above, it is likely that this will comprise soft drink syrup. However, if the apparatus is to be used for mixing and dispensing other types of materials, a supply of these materials will be substituted for the soft drink syrups. The sources of soft drink syrup are indicated at 101 on the schematic diagram.

As mentioned above, it may be preferable to have more than one container of syrup in communication with syrup supply line 128. Thus, as illustrated at 102 on the schematic diagram, two containers of syrup 101 are placed in communication with the syrup supply line 28. Syrup is removed from the containers 101 through pump 104.

In order to form a final mixture, an additional fluid component is required. In the case of a soft drink water will be required to be combined with the syrup. Thus, a water supply 106 is provided at a point remote from the remainder of the apparatus. Water supply 106 can simply be a municipal water supply. Water taken from the water supply 106 is then passed through a pair of filters 108 and 110. The water filtered by filter 108 then flows through fine filter 110. Thus, high quality water is provided for the final fluid mixture and impurities which may impede the operation of the apparatus are removed. The water is then transported or pumped through water supply line 112 into the apparatus.

In cases where it is desired to form carbonated beverages a carbonation system is provided within the interior of the apparatus. Thus, it is only necessary to supply carbon dioxide and water to the apparatus. FIG. 3 specifically illustrates a carbon dioxide tank 111. Carbon dioxide tank 111 is placed in communication with carbon dioxide line 114, which in turn transports the carbon dioxide to the interior of the apparatus.

Also illustrated in FIG. 3 is the warm water/detergent tank 174. It will be recalled that this tank provides warm water and/or a detergent solution for washing bottles and also for washing the apparatus as needed. Water can be provided to tank 174 through the general water supply of the remainder of the apparatus. That tank 174 is placed in communication with the bottle washer 128 and may also be placed in communication with a washing apparatus for cleaning various parts of the device.

In order to form carbonated water the water is preferably cooled in order to provide more effective carbonation. Thus, cooling take 158 is illustrated as part of the device. Once the water reaches a desired temperature within cooling tank 158, carbon dioxide is injected into the cool water within carbon dioxide factory 162. This produces a continuous supply of carbonated water. Thus, it is unnecessary to repeatedly replace carbonated water tanks in order to obtain a supply of carbonated water.

As illustrated in FIG. 3, the syrup line 128 may also be passed through the cool water bath to provide a cool source of both syrup and carbonated water. These components are then mixed together in the interior of a dispensing pump 166. Dispensing pump 166 then ejects the mixture through dispensing nozzle 134 into a waiting customer container.

The present invention is preferably provided with alarm systems to detect various deficiencies which may result in an undesirable product. The monitor of all systems is generally designated 115 in FIG. 3. Monitor 115 is in turn placed in communication with one or more alarms 116.

Various conditions may be monitored within the interior of the device. For example, the pressure and composition of the carbon dioxide entering the system can be monitored as illustrated at 118. At the same time, the purity and pressure of the water supply can be monitored as illustrated at 120. The temperatures and conditions within the cooling tank are also monitored at 122 in order to assure a high quality product. Various conventional monitoring and alarm systems are available for use in connection with the present invention.

All of these monitors assure that a good final product is provided. If pressure, for example, drops to too low a level an alarm can be activated shutting down the system or providing information concerning possible defects in the final product.

Also illustrated in FIG. 3 is a motor and compressor 126 for the refrigerator system. It will be appreciated that the motor and compressor 126 is mounted within the upper portion 20 of the cabinet 36. The motor and compressor provides refrigeration for the water within the cooling tank 158. The water within the cooling tank 158 is preferably maintained at approximately 32° F. Constant stirring of the water through the cooling tank prevents freezing.

Also illustrated in FIG. 3 is the bottle washer 128. Flow of warm water and possibly detergent to the bottle washer is provided through pump 30. This flow is monitored at monitor location 132. As mentioned above, bottle washer 128 is used to clean containers prior to receipt of the final mixed product. For example, a customer can rinse a previously used container in order to assure that it is sufficiently clean to receive the product being dispensed.

Finally, FIG. 3 illustrates a spill trough 146. Spill trough 146 is in turn in communication with waste collection line 154 which spills into waste container 152. As mentioned previously, material may be pumped out of waste container 152 through a pump 134. Pump 134 is in turn placed in communication with an outside disposal tank or sewer. The level of the contents of waste container 152 is continuously maintained in order to assure that it does not become overly full.

It will be appreciated from the discussion above that the present invention accomplishes all of the objectives set forth. The present invention provides a mixing and dispensing apparatus which is portable and movable. The apparatus may, for example, be placed at any location within a retail outlet. No specific special plumbing or electrical fixtures are required in order to install the device. At the same time, the device is configured so as to fit within a conventional grocery store aisle.

The present invention provides a mechanism for mixing and dispensing liquid mixtures in a convenient manner. A bulk liquid component, such as water, is provided from a remote source such that a virtually unlimited supply is available. The apparatus also includes on-site ability to process the water used. The apparatus is capable of filtering, adjusting temperature, and carbonating without the need for significant external equipment.

The present invention also provides an on-site source of the other necessary liquid components, such as soft drink syrup. The configuration of the lower section of the cabinet is such that syrup containers are easily installed and removed as needed. Thus, overall operation of the device is simplified.

The apparatus also effectively handles heat generation. The major heat operating components include the cooling apparatus, the carbonating factory, the lights and the dispensing pumps. All of these items are contained within the upper section of the cabinet. As a result, heat generated is exhausted through the top of the apparatus without containing heat sensitive supplies such as the syrups.

It will be appreciated, therefore, that each of the objects of the invention is accomplished. A free standing, portable device is provided for mixing and dispensing liquid compositions. The invention is configured so as to be usable in a conventional retail store environment.

It will be appreciated that the apparatus of the present invention is capable of being incorporated into the for of a variety of embodiments, only a few of which have been illustrated and described above. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A self-contained apparatus for preparing, mixing, and dispensing liquid mixtures comprising:

a cabinet;

a framework enclosed by said cabinet and having an upper portion, a center portion and a lower portion;

a source of at least one first liquid component of said liquid mixture carried on said framework;

means for supplying to said apparatus at least one second liquid component of said liquid mixture from a source remote from said apparatus;

means carried by said framework for mixing said components of the mixture;

means carried by said framework for dispensing the mixture into a container outside said cabinet;

means disposed within said framework for collecting excess liquid mixture and liquid waste generated during mixing and dispensing; and means for removing excess liquid mixture and liquid waste from said collecting means, said means for removing extending and moving said liquids from said means for collecting to and through the upper portion of the framework.

2. A self-contained apparatus for preparing, mixing, and dispensing liquid mixtures as defined in claim 1 further comprising means for adjusting the temperature of said at least one second liquid component.

3. A self-contained apparatus for preparing, mixing, and dispensing liquid mixtures as defined in claim 1 wherein said means for mixing said components comprises at least one dispensing pump disposed within said cabinet and placed in communication with at least one first liquid component and at least one second liquid component.

4. A self-contained apparatus for preparing, mixing, and dispensing liquid mixtures as defined in claim 1 wherein said means for dispensing the mixtures comprises a nozzle and valve means for controlling flow through said nozzle.

5. A self-contained apparatus for preparing, mixing, and dispensing liquid mixtures as defined in claim 1 wherein said means for collecting waste comprises a spill trough positioned beneath said dispensing means for collecting waste liquid, a waste collection line in liquid communication with said spill trough for transporting liquids collected from said spill trough, a waste container in communication with said waste collection line for collecting liquids transported by said waste collection line, and said means for removing comprises a pump for pumping liquids from the waste container, and a waste hose for carrying the pumped liquid waste away from the framework.

6. A self-contained apparatus for preparing, mixing, and dispensing liquid mixtures as defined in claim 1 wherein said means for supplying at least one second component comprises a hose in communication with the interior of the framework at its distal end and in communication with a source of said at least one second component at its proximal end.

7. A self-contained apparatus for preparing, mixing, and dispensing liquid mixtures as defined in claim 6 wherein said at least one second component comprises water.

8. A self-contained apparatus for preparing, mixing, and dispensing liquid mixtures as defined in claim 1 wherein said cabinet is configured such that it fits at the end of a conventional grocery store display without blocking the aisles adjacent to said display.

9. A self-contained apparatus for preparing, mixing, and dispensing liquid mixtures as defined in claim 8 wherein said cabinet is between approximately 4 feet and approximately 6 in length, and between approximately 3 feet and approximately 5 feet in width.

10. A self-contained apparatus for preparing, mixing, and dispensing liquid mixtures as defined in claim 1 further comprising means for incorporating a gas into said second liquid component.

11. A self-contained apparatus for preparing, mixing, and dispensing liquid mixtures as defined in claim 10 wherein said means for incorporating a gas comprises means for forming carbonated water.

12. A self-contained apparatus for preparing, mixing, and dispensing liquid mixtures as defined in claim 11 wherein said means for forming carbonated water is disposed within the upper portion of said framework.

13. A self-contained apparatus for preparing, mixing, and dispensing liquid mixtures as defined in claim 1 wherein said source of at least one first component is disposed within the lower portion of said cabinet and the interior of said lower portion being accessible through at least one door in the lower portion of said cabinet.

14. A self-contained apparatus for preparing, mixing, and dispensing liquid mixtures as defined in claim 13 wherein said source of at least one first component comprises a plurality of containers placed within said lower portion.

15. A self-contained apparatus for preparing, mixing, and dispensing liquid mixtures as defined in claim 14 wherein said containers are contained on a movable cart.

16. A self-contained apparatus for preparing, mixing, and dispensing liquid mixtures as defined in claim 15 wherein said cart comprises wheels such that said containers can be rolled into said cabinet and later rolled out of said cabinet through said door.

17. A self-contained apparatus for preparing, mixing, and dispensing liquid mixtures as defined in claim 16 wherein said containers comprise bag-in-box containers.

18. A self-contained apparatus for preparing, mixing, and dispensing liquid mixtures as defined in claim 17 wherein said first component comprises flavorings.

19. A self-contained apparatus for preparing, mixing, and dispensing liquid mixtures as defined in claim 14 wherein said source of said at least one first component further comprises a plurality of tubes, at least one tube being in communication with each container.

20. A self-contained apparatus for preparing, mixing, and dispensing liquid mixtures as defined in claim 19 wherein said source of said at least one first component further comprising means for causing said at least one first component to flow out of said container through said tube.

21. A self-contained apparatus for preparing, mixing, and dispensing liquid mixtures as defined in claim 20 wherein said means for causing flow comprises at least one pump.

22. A self-contained apparatus for preparing, mixing, and dispensing liquid mixtures as defined in claim 21 comprising one pump associated with and capable of causing flow within each tube.

23. An apparatus for mixing and disposing soft drinks comprising:

a cabinet;

a source of at least one flavoring for said soft drinks disposed within said cabinet;

means for supplying water to said cabinet from a source remote from said cabinet;

means for adjusting the temperature of the water; means for carbonating the water;

means disposed within the cabinet for mixing the carbonated water with the at least one flavoring to product a soft drink;

means within the cabinet for dispensing the soft drink into a container outside the cabinet; and means disposed within said cabinet for collecting waste soft drink generated during mixing and dispensing, and means for removing the collected waste from the cabinet, said means for removing extending through the top of the cabinet and away from the cabinet.

24. An apparatus for mixing and dispensing soft drinks as defined in claim 23 wherein said means for supplying water comprises a hose in communication with the interior of the cabinet at its distal end and in communication with a source of water at its proximal end.

25. An apparatus for mixing and dispensing soft drinks as defined in claim 24 further comprising means for filtering the water before it is mixed with said flavoring.

26. An apparatus for mixing and dispensing soft drinks as defined in claim 23 further comprising means for removing heat from the interior of said cabinet.

27. An apparatus for mixing and dispensing soft drinks as defined in claim 26 wherein said heat removing means comprises venting heat through the upper section, of said cabinet.

28. An apparatus for mixing and dispensing soft drinks as defined claim 23 wherein said containers of soft drink syrup comprise bag-in-bag containers.

29. An apparatus for mixing and dispensing soft drinks as defined claim 28 wherein said bag-in-box containers rest upon a wheeled cart capable of holding a plurality of containers and capable of being placed within the interior of said lower portion.

30. An apparatus for mixing and dispensing soft drinks as defined claim 29 wherein the lower portion of said cabinet comprises at least one door which can be selectively opened and closed and through which said cart containing bag-in-box containers can pass.

31. An apparatus for mixing and dispensing soft drinks as defined claim 23 wherein said cabinet comprise an upper portion, a center portion and a lower portion.

32. An apparatus for mixing and dispensing soft drinks as defined claim 31 wherein said source of flavorings comprises at least one container of soft drink syrup disposed within said lower portion.

33. An apparatus for mixing and dispensing soft drinks as defined in claim 32 wherein said source of flavorings further comprises at least one tube being in communication with said at least one container of soft drink syrup.

34. An apparatus for mixing and dispensing soft drinks as defined in claim 33 further comprising means for causing said soft drink syrup to flow out of said container through said tube.

35. An apparatus for mixing and dispensing soft drinks as defined in claim 34 wherein said means for causing flow comprises at least one pump.

36. A self-contained soft drink dispensing apparatus comprising:

a cabinet configured such that is can be placed on the end of a conventional grocery store display without blocking aisles adjacent to said display;

means for supplying water to said cabinet;

means disposed within said cabinet for cooling the water;

means disposed within said cabinet for carbonating the water;

a source of at least one soft drink flavoring disposed within the cabinet;

means for mixing the carbonated water with the flavoring to form a soft drink;

means for dispensing the soft drink;

means within the cabinet for collecting waste liquid from said means for dispensing; and means for removing waste liquid from said means for collecting with said means for removing extending upwardly through the interior and top of the cabinet.

37. A self-contained soft drink dispensing apparatus as defined in claim 36 wherein said cabinet is between approximately 4 feet and approximately 6 feet in length, and between approximately 3 feet and approximately 5 feet in width.

38. A self-contained soft drink dispensing apparatus as defined in claim 36 wherein said means for carbonating water comprises a carbonation factory.

39. A self-contained soft drink dispensing apparatus as defined in claim 36 wherein said means for mixing the carbonated water with the flavoring to form a soft drink comprises a dispensing pump.

40. A self-contained soft drink dispensing apparatus as defined in claim 36 further comprising means for holding a plurality of soft drink containers.

41. A self-contained soft drink dispensing apparatus as defined in claim 40 further comprising means disposed within said cabinet for washing said soft drink containers.

42. A self-contained soft drink dispensing apparatus as defined in claim 36 wherein said means for collecting waste liquid comprises a container disposed within the cabinet.

43. A self-contained soft drink dispensing apparatus as defined in claim 42 wherein said removal means comprises a pump and a waste disposal tube disposed within said cabinet such that the pump can cause waste fluid to flow within the waste disposal tube.

44. A self-contained soft drink dispensing apparatus as defined in claim 43 wherein the waste disposal tube is in communication with the waste container at one end, travels upwardly through the cabinet, exits the cabinet and terminates at a remote waste disposal location.

45. An apparatus for dispensing a liquid beverage comprising in combination:

a cabinet for carrying a liquid concentrate and a liquid diluent at spaced locations, having at least one lateral dimension which corresponds in size to the lateral dimension of a grocery store shelving aisle;

means carried by the cabinet for mixing concentrate and diluent and for subsequently dispensing the resulting mixture;

means carried by the cabinet for collecting waste fluid; and means for removing waste fluids from said means for collecting waste fluids with said means for removing extending from said collection means to and through the top of the cabinet.

46. Apparatus for dispensing a soft drink comprising in combination:

a framework for carrying syrup and diluent at spaced locations, said framework having at least one lateral dimension which corresponds in size to the lateral dimension of a grocery store shelving isle; means carried by the framework for mixing the syrup and diluent;

means for collecting waste fluids; and means for transporting said waste fluids away from apparatus and upwardly through the top of the framework so as to avoid flow through a floor drain beneath said apparatus.

* * * * *

UNITED STATES PATENT AND TRADEMARK OFFICE

CERTIFICATE OF CORRECTION

PATENT NO. : 4,928,853

DATED : May 29, 1990

INVENTOR(S) : WILLIAM R. ISHAM et al.

It is certified that error appears in the above-identified patent and that said Letters Patent is hereby corrected as shown below:

Title page, item [75] where Inventors are listed, after "William J. Wermeling, Wilton, Conn." insert --Allen G. Webb, Layton, Utah--

Column 5, line 3, "the" should be --The--

Column 15, line 45, "product" should be --produce--

Signed and Seated this

Twenty-eighth Day of September, 1993

Bruce Lehman

*Attest:*

BRUCE LEHMAN

*Attesting Officer*

*Commissioner of Patents and Trademarks*